US009523510B2

(12) United States Patent
Kolt et al.

(10) Patent No.: US 9,523,510 B2
(45) Date of Patent: Dec. 20, 2016

(54) ROOF VENT

(71) Applicants: Martin K. Kolt, Spring Valley, NY (US); Ethan J. Kolt, Hopewell Junctions, NY (US)

(72) Inventors: Martin K. Kolt, Spring Valley, NY (US); Ethan J. Kolt, Hopewell Junctions, NY (US)

( * ) Notice: Subject to any disclaimer, the term of this patent is extended or adjusted under 35 U.S.C. 154(b) by 396 days.

(21) Appl. No.: 14/194,838

(22) Filed: Mar. 3, 2014

(65) Prior Publication Data

US 2014/0248834 A1 Sep. 4, 2014

Related U.S. Application Data

(60) Provisional application No. 61/771,839, filed on Mar. 2, 2013.

(51) Int. Cl.
*F24F 7/02* (2006.01)

(52) U.S. Cl.
CPC ..... *F24F 7/02* (2013.01); *Y10T 29/49623* (2015.01)

(58) Field of Classification Search
CPC ..... F24F 7/02
USPC ..... 454/3, 4, 94, 128, 133, 365, 366, 367; 52/199, 198
See application file for complete search history.

(56) References Cited

U.S. PATENT DOCUMENTS 4,890,546 A * 1/1990 Venge ..... F24F 7/025 454/242
5,094,041 A * 3/1992 Kasner ..... F24F 7/02 454/365
5,427,571 A * 6/1995 Sells ..... E04D 3/40 454/365
5,941,028 A * 8/1999 Hicks ..... E04D 13/152 454/260
6,733,381 B1 * 5/2004 Ploeger ..... F24F 13/082 3/82
7,992,356 B2 * 8/2011 Grossman ..... F24F 7/02 52/192
2006/0240762 A1 * 10/2006 Railkar ..... F24F 7/02 454/260
2007/0117505 A1 * 5/2007 Wey ..... E04D 13/176 454/366
2009/0113823 A1 * 5/2009 Osborne ..... F24F 7/02 52/198

* cited by examiner

*Primary Examiner* — Avinash Savani
*Assistant Examiner* — Vivek Shirsat
(74) *Attorney, Agent, or Firm* — Law Offices of Michael L. Wise, LLC

(57) ABSTRACT

Aspects of the invention provide a roof vent comprising a first portion, a second portion, a third portion, and a fourth portion. The second portion is connected to the first portion. The third portion is connected to the second portion and defines one or more openings therein. The fourth portion is connected to the third portion. In a first region of the roof vent when the first portion and the third portion are resting on a horizontal surface, the second portion angles upward away from the first portion and the third portion angles downward towards, but does not contact, the first portion so as to create a gap in a bottom of the roof vent in gaseous communication with the one or more openings. In a second region of the roof vent, the second portion is substantially coplanar with the first portion, and a part of the second portion is pressed directly against a part of the third portion, which is pressed directly against a part of the fourth portion.

20 Claims, 5 Drawing Sheets

100
145
140
130
110
105
2
2
145
140

1E
120
1E
1D
115
1D

110

120
115
125
110
135
105

135

ROOF VENT

FIELD OF THE INVENTION

The present invention relates generally to apparatus for ventilating buildings, and, more particularly, to roof vents and the like.

BACKGROUND OF THE INVENTION

Roof vents play a major role in maintaining the integrity of a building. In cold weather, roof ventilation maintains a cold roof temperature and thereby avoids ice damns created by melting snow. The ventilation also allows any moisture that enters the attic of the building to escape. In warm weather, roof ventilation helps to expel hot air from the attic to reduce the building's cooling load.

Dormer vents are a common type of roof vent that are generally installed on the sloping portions of a roof system. As their name would suggest, dormer vents resemble building dormers, that is, windows that project vertically from a sloping roof. Nevertheless, despite their widespread usage, present versions of such dormer vents have several disadvantages. Because of their complex shapes, dormer vents are typically formed by joining several sections of material together. As a result, they may be difficult to manufacture. Moreover, the seams produced by the joined sections of material may produce weak spots that are susceptible to water leakage.

For the foregoing reasons, there is a need for new roof vent designs that are easy to manufacture and avoid joined seams that can lead to water leakage.

SUMMARY OF THE INVENTION

Embodiments of the present invention address the above-identified needs by providing improved roof vent designs.

Aspects of the invention provide a roof vent comprising a first portion, a second portion, a third portion, and a fourth portion. The second portion is connected to the first portion. The third portion is connected to the second portion and defines one or more openings therein. The fourth portion is connected to the third portion. In a first region of the roof vent when the first portion and the third portion are resting on a horizontal surface, the second portion angles upward away from the first portion and the third portion angles downward towards, but does not contact, the first portion so as to create a gap in a bottom of the roof vent in gaseous communication with the one or more openings. In a second region of the roof vent, the second portion is substantially coplanar with the first portion, and a part of the second portion is pressed directly against a part of the third portion, which is pressed directly against a part of the fourth portion.

Additional aspects of the invention provide a method for forming a roof vent. An assembly is formed comprising a first portion, a second portion, a third portion, and a fourth portion. The second portion is connected to the first portion. The third portion is connected to the second portion and defines one or more openings therein. The fourth portion is connected to the third portion. The assembly is processed such that, in a first region of the roof vent when the first portion and the third portion are resting on a horizontal surface, the second portion angles upward away from the first portion and the third portion angles downward towards, but does not contact, the first portion so as to create a gap in the bottom of the roof vent in gaseous communication with the one or more openings. The assembly is further processed such that, in a second region of the roof vent, the second portion is substantially coplanar with the first portion, and a part of the second portion is pressed directly against a part of the third portion, which is pressed directly against a part of the fourth portion.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

The present invention will be described with reference to illustrative embodiments. For this reason, numerous modifications can be made to these embodiments and the results will still come within the scope of the invention. No limitations with respect to the specific embodiments described herein are intended or should be inferred.

Figures 1A, 1B, 1C, 1D, 1E, 1F, 1G, 1H:
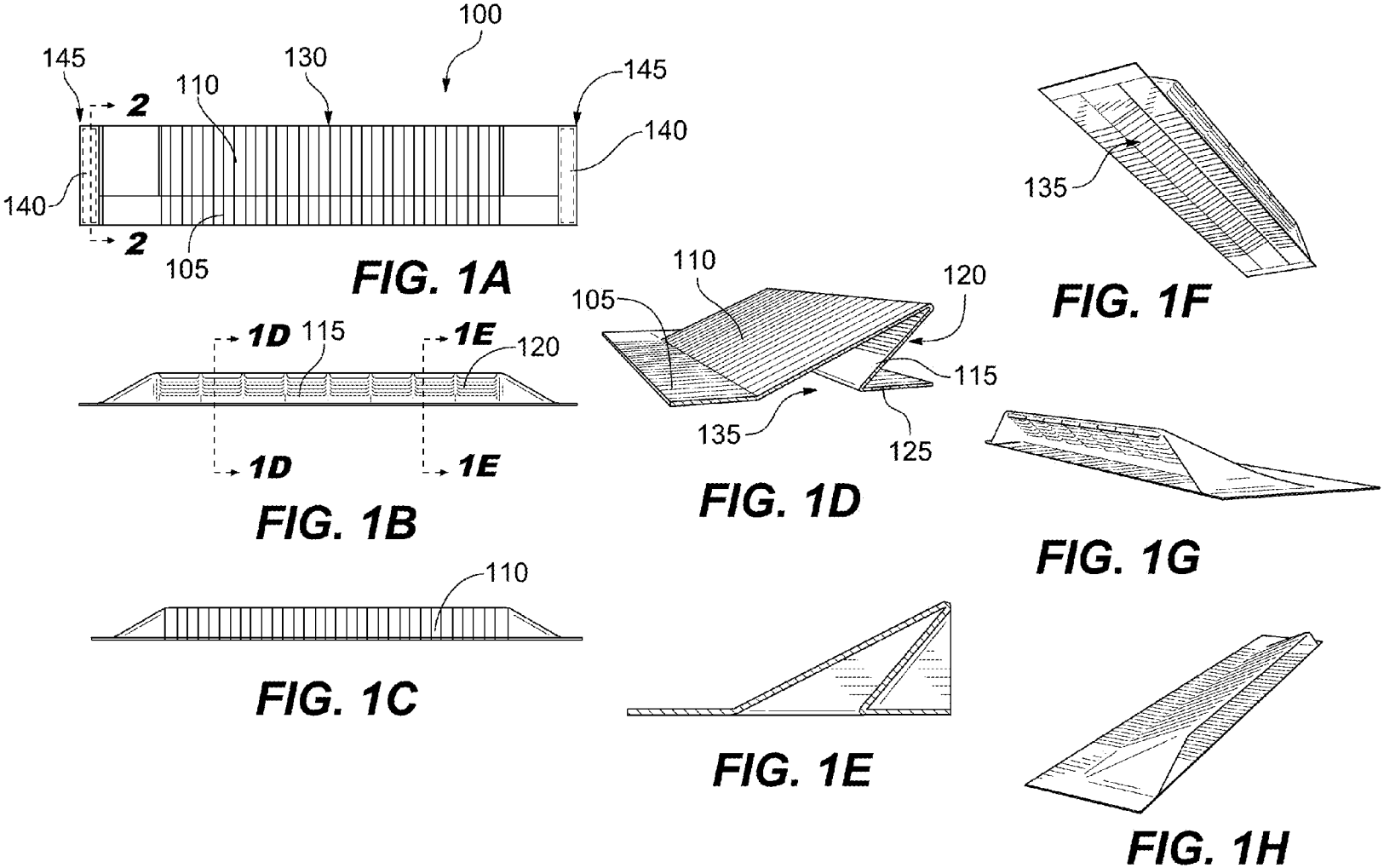
FIG. 1A shows a plan view of a roof vent in accordance with an illustrative embodiment of the invention.
FIG. 1B shows a front elevational view of the FIG. 1A roof vent.
FIG. 1C shows a rear elevational view of the FIG. 1A roof vent.
FIG. 1D shows a perspective sectional view of the FIG. 1A roof vent cut along a plane indicated in FIG. 1B.
FIG. 1E shows a side sectional view of the FIG. 1A roof vent cut along a plane indicated in FIG. 1B.
FIG. 1F shows a bottom perspective view of the FIG. 1A roof vent.
FIG. 1G shows a side perspective view of the FIG. 1A roof vent.
FIG. 1H shows a top perspective view of the FIG. 1A roof vent.

FIG. 1A-1H show various views of a roof vent 100 in accordance with an illustrative embodiment of the invention. More particularly, FIG. 1A shows a plan view, FIG. 1B shows a front elevational view, FIG. 1C shows a rear elevational view, FIG. 1D shows a perspective sectional view cut along a plane indicated in FIG. 1B, FIG. 1E shows a side sectional view cut along a plane indicated in FIG. 1B, FIG. 1F shows a bottom perspective view, FIG. 1G shows a side perspective view, and FIG. 1H shows a top perspective view.

Figure 2:
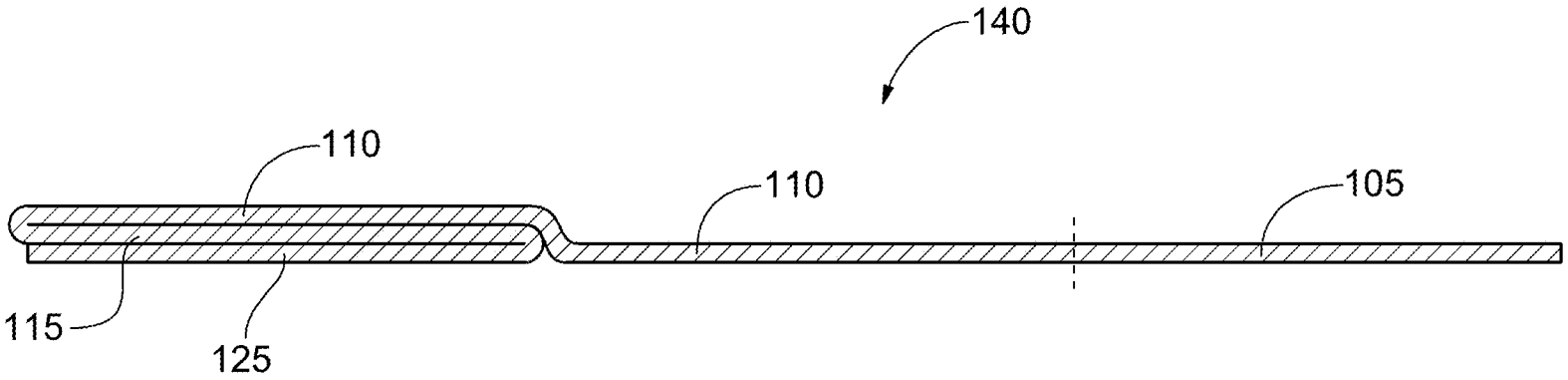
FIG. 2 shows a sectional view of an edge region of the roof vent in FIGS. 1A-1H.

For ease of description, the roof vent 100 may be conceptually separated into four portions. A first portion 105 is connected to a second portion 110. The second portion 110 is angularly connected to a third portion 115, which defines a plurality of ventilation slits 120 therein. Lastly, the third portion 115 is angularly connected to a fourth portion 125. The four portions 105, 110, 115, 125 of the roof vent 100, in turn, take on different configurations when considered along the long axis of the roof vent 100 (i.e., the left-right axis in FIGS. 1A-1C). With the first portion 105 and the fourth portion 125 of the roof vent 100 oriented horizontally in the manner shown in the figures, a center region 130 of the roof vent 100 is characterized by the second portion 110 being angled upward away from the first portion 105, and the third portion 115 being angled downward towards, but not in contact with, the first portion 105. This configuration provides a gap 135 in the bottom of the roof vent 100 with the gap 135 in gaseous communication with the ventilation slits 120 in the third portion 115. In contrast, in edge regions 140 along two edges 145 of the roof vent 100, the second portion 110 is instead substantially coplanar (i.e., aligned) with the first portion 105 and a region of the second portion 110 is pressed directly against a region of the third portion 115, which is pressed directly against a region of the fourth portion 125. This edge configuration is shown in a sectional view in FIG. 2. Accordingly, adjacent to the edges 145, one finds fairly planar edge margins that run along the short axis of the roof vent 100. Between the center region 130 and the edge regions 140 of the roof vent 100, but closer to the edge regions 140, the four portions 105, 110, 115, 125 take on complex angled and curved shapes as they gradually transition from the center configuration to the edge configuration.

Figure 3:
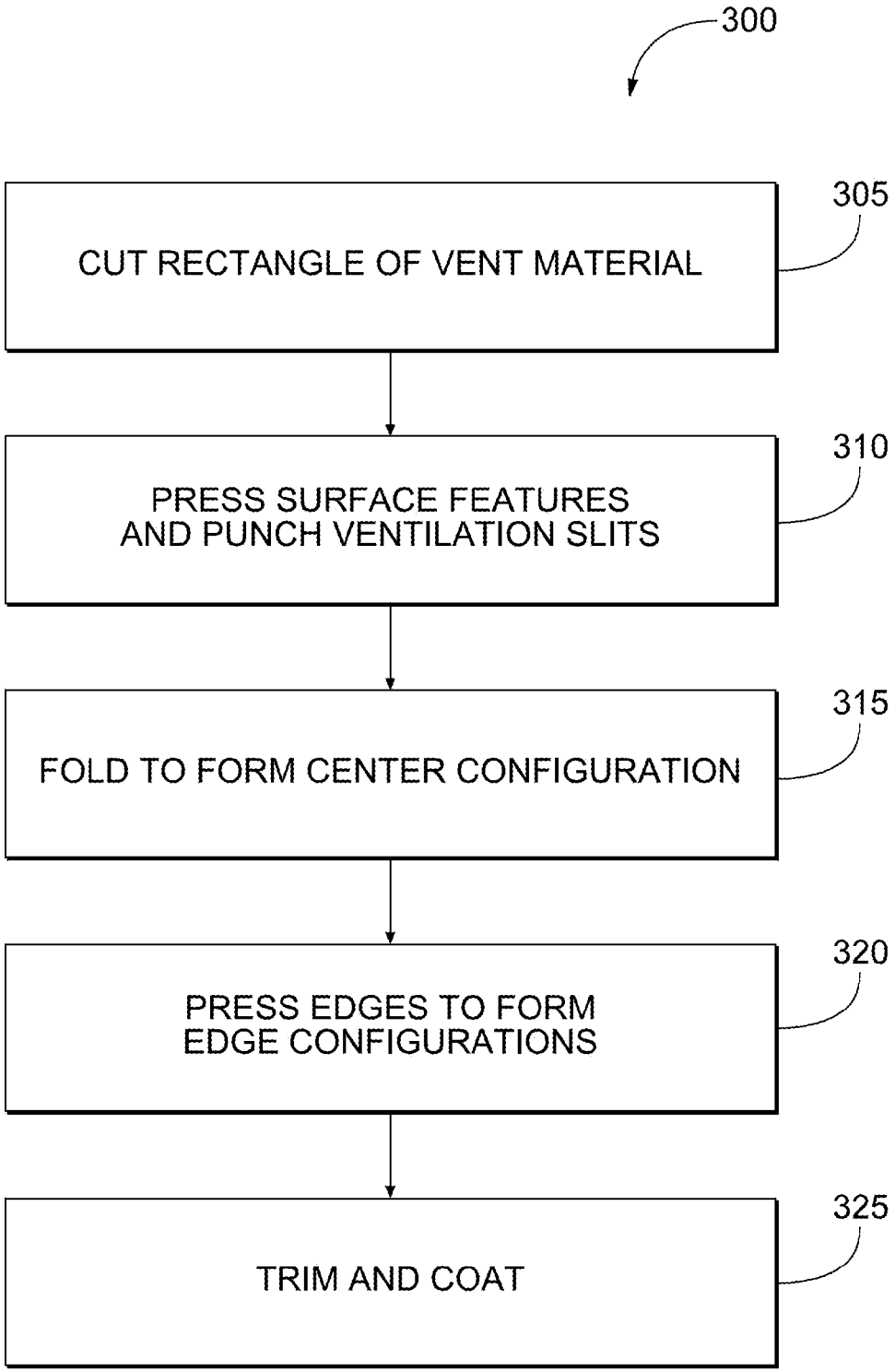
FIG. 3 shows a flow diagram of a method for forming the roof vent in FIGS. 1A-1H, in accordance with an illustrative embodiment of the invention.

The roof vent 100 may comprise a tool-malleable metal such as, but not limited to, aluminum, stainless steel, and copper. Notably, the entire roof vent 100 can be formed of a single piece of material that does not include any joined seams. For purposes of this invention, a "joined seam" is intended to encompass an interface defined by two previously-separate sections of material that are joined to one another by a means of fixation such as, but not limited to, gluing, nailing, screwing, clamping, welding, brazing, soldering, and riveting. FIG. 3 shows a flow diagram of a method for forming the roof vent 100 in accordance with an illustrative embodiment of the invention. In one or more embodiments, for example, a single sheet of aluminum may be cut to produce a flat rectangular piece (step 305). The flat rectangular piece may then be pressed to produce any desired surface features for the vent (e.g., surface ridges) and punched to produce the ventilation slits 120 (in this case louvered slits with integral slats) (step 310). Subsequently, the rectangular piece may then be folded so as to define the first portion 105, the second portion 110, the third portion 115, and the fourth portion 125 in a configuration desired for the center region 130 of the roof vent 100 (step 315). Finally, margins along the edges 145 of the second portion 110 and the third portion 115 may be pressed against the fourth portion 125 to produce the substantially planar edge regions 140 (step 320). The resultant roof vent 100 may also be trimmed as desired and painted or otherwise coated with a surface protectant (step 325).

Figure 4:
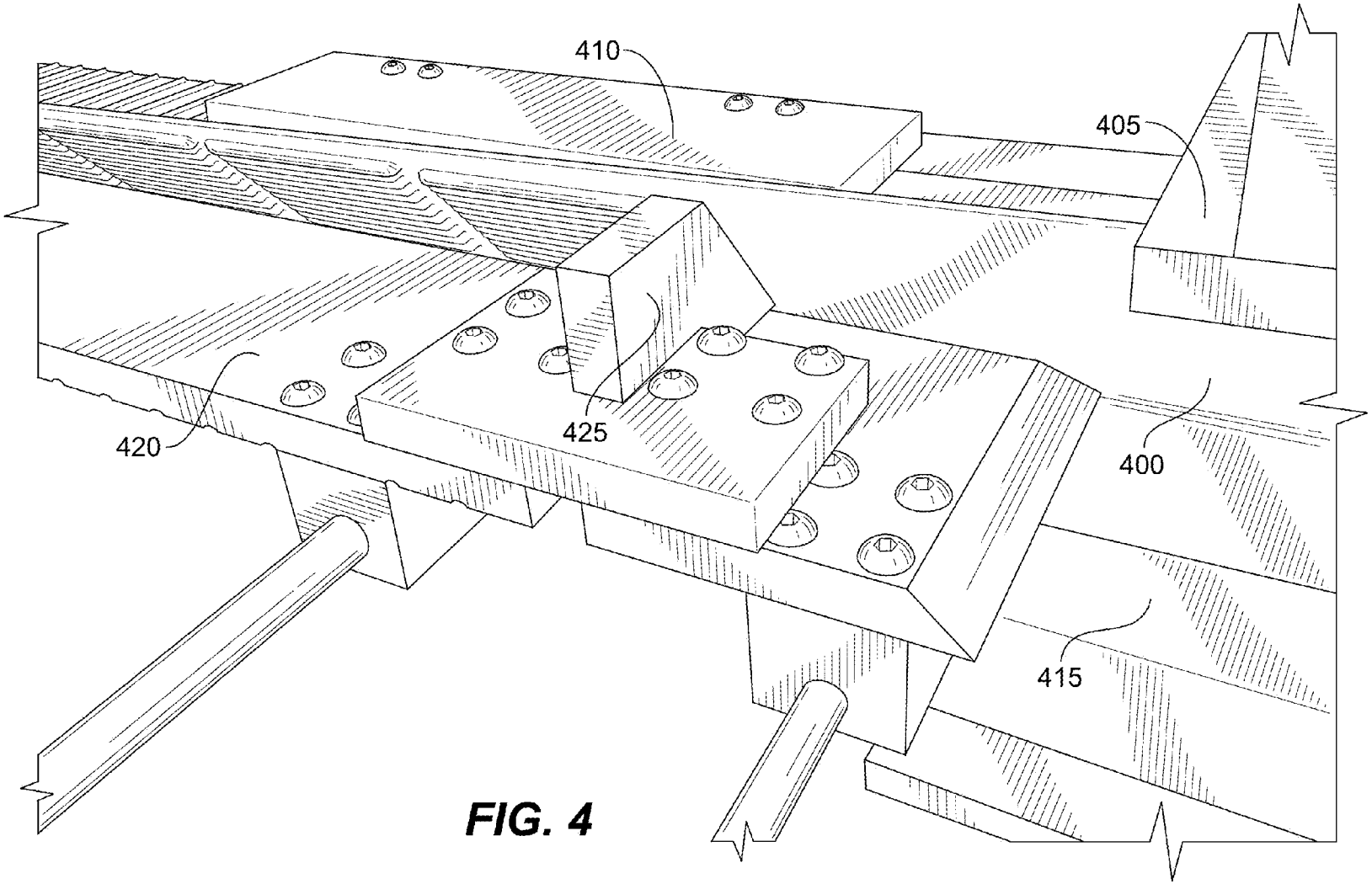
FIG. 4 shows a perspective view of an unfinished roof vent in conformity with the roof vent in FIGS. 1A-1H while installed in a press during manufacture.

FIG. 4 shows a perspective view of an unfinished roof vent 300 corresponding to the illustrative roof vent 100 after step 315, but just before one of its edges is pressed by a pneumatic metal press in accordance with step 320. During pressing (step 320), a pressing plate 405 pushes downward on the edge region of the roof vent 400. At the same time, a first holding plate 410 presses the first portion of the roof vent 400 against a horizontal table 415 while a second holding plate 420 presses the fourth portion of the roof vent 400 against the horizontal table 415. Finally, an angled piece 425 supports the third portion of the roof vent 400 inboard from the edge and, in combination with beveled edges on the second holding plate 420, allows the roof vent 400 to take on the desired shape during the pressing process.

Accordingly, while the design and function of the roof vent 100 are entirely novel, embodiments of the invention may be produced utilizing conventional metal working techniques and metal forming tools that will be familiar to one having ordinary skill in the metal fabrication arts. Moreover, such metal fabrication techniques are described in a number of readily available publications, such as, for example, O.D. Lascoe, *Handbook of Fabrication Processes*, ASM International, 1988, which is hereby incorporated by reference herein.

The roof vent 100, and, more generally, roof vents in accordance with aspects of the invention, may be installed on a sloping roof over a slit-shaped opening in that roof to provide a means of ventilation for an underlying building. The roof vent 100 is preferably installed on a sloping roof such that the first portion 105 is positioned higher on the sloping roof than the fourth portion 125, while the gap 135 overlies the slit-shaped opening in the roof. During installation, the first portion 105 is preferably attached to the roof under the shingles. The fourth portion 125 of the roof vent 100, in contrast, is preferably attached to the roof over the shingles. Fasteners, such as, but not limited to, nails or screws placed along the perimeter of the roof vent 100 may provide the actual means of fixation.

Once installed in this manner, the roof vent 100 becomes what is commonly called a "dormer vent." The positioning of the second portion 110 over the ventilation slits 120 creates a covering which inhibits precipitation from entering the ventilation slits 120 from above. At the same time, the louvered ventilation slits 120 further inhibit water from passing through the roof vent 100 into the underlying building as a result of precipitation being pushed sideways by wind. Perhaps most importantly, the lack of joined seams in the roof vent 100 substantially eliminates any weak points in the roof vent 100. Accordingly, the chance of leakage is substantially reduced when compared to those prior art roof vent designs that are not formed in this manner.

At the same time, roof vents in accordance with aspects of the invention, unlike many prior art roof vent designs, may be formed utilizing conventional metal forming techniques (e.g., cutting, stamping, bending, pressing) without the need to perform any metal joining processes (e.g., welding, brazing, soldering, riveting). The present roof vent designs are therefore also relatively easy and cost effective to manufacture.

It should again be emphasized that the above-described embodiments of the invention are intended to be illustrative only. Other embodiments can use different types and arrangements of elements for implementing the described functionality. These numerous alternative embodiments within the scope of the appended claims will be apparent to one skilled in the art.

Figure 5:
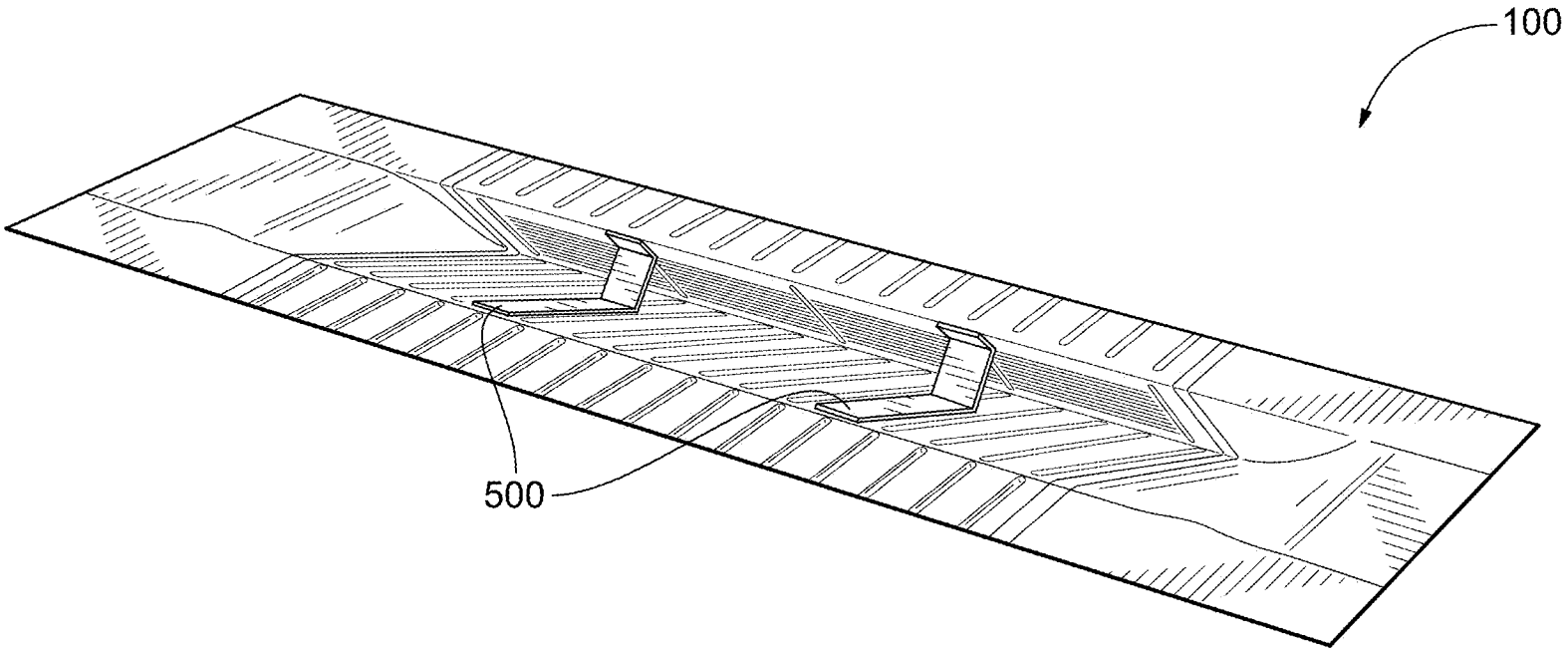
FIG. 5 shows a bottom perspective view of the FIG. 1A roof vent with the addition of optional reinforcing elements in accordance with an illustrative embodiment of the invention.

It may, for example, in one or more alternative embodiments falling within the scope of the invention, be beneficial to install one or more reinforcement elements in the roof vent 100. FIG. 5 shows a bottom perspective view of the roof vent 100 with reinforcing elements 500. In this particular illustrative, non-limiting embodiment, the reinforcing elements 500 comprise bent brackets (of, e.g., metal or plastic) that are periodically placed into the space between the second portion 110 and the third portion 115. The reinforcing elements 500 may help to prevent the roof vent 100 from being crushed under heavy loads such as those that may be encountered when a roof is covered in snow. It is contemplated that the longer the roof vent, the greater number of such reinforcing elements that may be utilized.

All the features disclosed herein may be replaced by alternative features serving the same, equivalent, or similar purposes, unless expressly stated otherwise. Thus, unless expressly stated otherwise, each feature disclosed is one example only of a generic series of equivalent or similar features.

Any element in a claim that does not explicitly state "means for" performing a specified function or "step for" performing a specified function is not to be interpreted as a "means for" or "step for" clause as specified in 35 U.S.C. §112, ¶6. In particular, the use of "step of" in the claims herein is not intended to invoke the provisions of 35 U.S.C. §112, ¶6.

What is claimed is:

1. A roof vent comprising:

a first portion;

a second portion, the second portion connected to the first portion;

a third portion, the third portion connected to the second portion and defining one or more openings therein; and a fourth portion, the fourth portion connected to the third portion;

wherein, in a first region of the roof vent when the first portion and the third portion are resting on a horizontal surface, the second portion angles upward away from the first portion and the third portion angles downward towards, but does not contact, the first portion so as to create a gap in a bottom of the roof vent in gaseous communication with the one or more openings;

wherein, in a second region of the roof vent, at least some of the second portion is coplanar with the first portion, and a planar part of the second portion directly overlies a planar part of the third portion, which directly overlies a planar part of the fourth portion so that the three planar parts form a layered, folded edge.

2. The roof vent of claim 1, wherein the first region encompasses a center of the roof vent.

3. The roof vent of claim 1, wherein the second region encompasses a margin along an edge of the roof vent.

4. The roof vent of claim 1, wherein the first portion, the second portion, the third portion, and the fourth portion consist of a single piece of material without joined seams.

5. The roof vent of claim 1, wherein the roof vent comprises a metal.

6. The roof vent of claim 1, wherein the one or more openings comprise a plurality of slits.

7. The roof vent of claim 1, wherein the one or more openings comprise a plurality of slats.

8. The roof vent of claim 1, wherein the first portion comprises a plurality of ridges.

9. The roof vent of claim 8, wherein the plurality of ridges run parallel to one another.

10. The roof vent of claim 1, wherein the second portion defines a plurality of ridges.

11. The roof vent of claim 10, wherein the plurality of ridges run parallel to one another.

12. The roof vent of claim 1, wherein the fourth portion defines a plurality of ridges.

13. The roof vent of claim 12, wherein the plurality of ridges run parallel to one another.

14. The roof vent of claim 1, further comprising a reinforcing element, the reinforcing element spanning between the second portion and the third portion.

15. A method for forming a roof vent, the method comprising the steps of:

(a) forming an assembly comprising:

(i) a first portion;

(ii) a second portion, the second portion connected to the first portion;

(iii) a third portion, the third portion connected to the second portion and defining one or more openings therein; and (iv) a fourth portion, the fourth portion connected to the third portion;

(b) processing the assembly such that, in a first region of the roof vent when the first portion and the third portion are resting on a horizontal surface, the second portion angles upward away from the first portion and the third portion angles downward towards, but does not contact, the first portion so as to create a gap in a bottom of the roof vent in gaseous communication with the one or more openings; and (c) processing the assembly such that, in a second region of the roof vent, at least some of the second portion is coplanar with the first portion, and a planar part of the second portion directly overlies a planar part of the third portion, which directly overlies a planar part of the fourth portion so that the three planar parts form a layered, folded edge.

16. The method of claim 15, wherein step (a) comprises cutting out a rectangular portion of material.

17. The method of claim 15, wherein step (a) comprises punching the one or more openings.

18. The method of claim 15, wherein step (b) comprises bending.

19. The method of claim 15, wherein step (c) comprises pressing.

20. The method of claim 15, wherein the first portion, the second portion, the third portion, and the fourth portion consist of a single piece of material without joined seams.

* * * * *